US011827413B2

(12) United States Patent
Ajamian

(10) Patent No.: US 11,827,413 B2
(45) Date of Patent: Nov. 28, 2023

(54) METHOD OF MAKING PACKING BOXES FOR SHIPPING AND STORAGE

(71) Applicant: Arnaud Z Ajamian, North Salem, NY (US)

(72) Inventor: Arnaud Z Ajamian, North Salem, NY (US)

( * ) Notice: Subject to any disclaimer, the term of this patent is extended or adjusted under 35 U.S.C. 154(b) by 332 days.

(21) Appl. No.: 16/163,360

(22) Filed: Oct. 17, 2018

(65) Prior Publication Data

US 2020/0122883 A1 Apr. 23, 2020

(51) Int. Cl.
*B65D 6/24* (2006.01)
*B65D 21/08* (2006.01)
*B65D 6/16* (2006.01)

(52) U.S. Cl.
CPC ..... *B65D 11/1873* (2013.01); *B65D 7/24* (2013.01); *B65D 21/083* (2013.01); *B65D 21/086* (2013.01)

(58) Field of Classification Search
CPC .... B65D 11/1873; B65D 7/24; B65D 21/083; B65D 21/086; B65D 17/36; B65D 17/52; B65D 50/067; B66F 15/00; A63H 33/062; A63H 33/08; A63H 33/065; A63H 33/082; A63H 33/084; A63H 33/086; A63H 33/06; A63H 33/088
USPC ..... 220/4.28; 229/117.19
See application file for complete search history.

(56) References Cited

U.S. PATENT DOCUMENTS 419,099 A * 1/1890 Arold ..... A63H 33/103 446/121
2,972,833 A * 2/1961 Pascal ..... A63H 33/062 59/80
4,822,315 A * 4/1989 Ben-Gal ..... A63H 33/08 446/104
5,070,564 A * 12/1991 Fey ..... B66F 19/005 7/170
5,853,314 A * 12/1998 Bora ..... A63H 33/086 446/124
2003/0106894 A1* 6/2003 Budowski ..... B60R 11/06 220/4.28
2012/0015583 A1* 1/2012 Chen ..... A63H 33/086 446/124
2019/0316825 A1* 10/2019 Dai ..... F25D 3/00

* cited by examiner

*Primary Examiner* — Andrew D Perreault

(57) ABSTRACT

The present application discloses a new method of making, using, and constructing packing boxes that can be used for shipping or storage. In one embodiment, a packing box is constructed from a set of assembly pieces. Each assembly piece comprises a square body with four sides. On each side of the square body, there is either a key or a lock. Two assembly pieces can be connected or locked through insertion of a key of one assembly piece into a lock of another assembly piece. Two locked pieces can be unlocked by pushing on the key via the indentation above the lock of one locked assembly piece that receives the key of another locked pieces. Assembly pieces of different shapes required for constructing a box are disclosed.

11 Claims, 13 Drawing Sheets

METHOD OF MAKING PACKING BOXES FOR SHIPPING AND STORAGE

FIELD OF THE INVENTION

The present disclosure relates generally to packing boxes, and more specifically to a new type of reusable packing boxes for shipping and storage.

BACKGROUND OF THE INVENTION

Corrugated packing boxes are commonly used for shipping and storage. They can be folded into boxes quickly and can be flattened when the content is removed. These boxes are cheap and convenient. They come in different colors and sizes, but they all have the same design: four side walls with four flaps for the bottom and four for the top. The four flaps can be locked to form the bottom for holding the weight or to form the top for closing the box. The bottom can be reinforced by tapes, especially along the edges where the flaps interlock.

However, corrugated boxes are made of cardboard and are not durable. After one or two uses, cardboard boxes become worn and can't withstand any significant weight any more. They have to be discarded. Although the cardboard can be recycled, corrugated boxes are still wasteful and harmful to the environment.

The present disclosure teaches a new type of boxes that are flexible and versatile and can be made of reusable/durable materials for repeated uses. They are easy to manufacture, and more importantly, they are environmentally safe.

SUMMARY OF THE INVENTION

Accordingly, it is an objective of the present disclosure to teach a new type of packing boxes that can be used for shipping and storage and the method of making and using them.

In some embodiments, an article of manufacture comprises a set of assembly pieces. Each assembly piece comprises a body in the shape of a square, referred to as "square body." On each side of the square body, there is either a key or a lock. Each key is attached to the square and each lock is a socket inside the square body. In one embodiment, a key is a small tab. The tab may be flat on one side and have some unevenness on the other side. The unevenness can be made of any shape, e.g., a prism. In the set of assembly pieces, any assembly piece can be connected to another assembly piece through insertion of a key of either piece into a lock of the other piece. The set of assembly pieces also comprises a top piece. The top piece differs from the other pieces in that the top piece has an aperture on the square body. The article of manufacture may also include a box opener. The box opener comprises a handle and a lug. The lug can be inserted in the aperture of the top piece to remove the top piece from an assembled box to open the box during disassembling. In some embodiments, every key is of the same shape and size. Every lock is of the same shape and size as a key to allow a key to be securely inserted into a lock.

In some embodiments, the set of assembly pieces includes one or more planar assembly pieces. A planar assembly piece includes one or more keys, all of which are flat and lying in the same plane as the square body. When two planar assembly pieces are connected, they form a flat surface. The set of assembly pieces further includes one or more non-planar assembly pieces. A non-planar assembly piece includes at least one vertical key that is perpendicular to the plane of the square body. When the vertical key of a non-planar assembly piece is inserted into a lock of another assembly piece, the two assembly pieces form a 90° angle. Among the set of assembly pieces, a plurality of pieces can be selected to construct a box. In some embodiments, a top piece is included in the selected pieces for assembling a box. The top piece has an aperture in the square body. The aperture is used to receive a box opener for disassembling.

In some embodiments, the assembly pieces may be made of cardboard, plastic, metal, or other suitable materials. The assembly pieces in the same set may be made of the same or different materials.

In some embodiments, the surface of the square body of each assembly piece may be marked by indentations. An indentation is generally marked above each lock and is used for pushing the key inserted into the lock beneath the indentation to unlock two locked assembly pieces.

The present application further discloses a method of assembling a box using a set of assembly pieces. In the set of assembly pieces, each assembly piece comprises a square body and, on each side of the square body, either a key or a lock. Two assembly pieces connect to each other through insertion of a key of one assembly piece into a lock of the other assembly piece. The set of assembly pieces further comprises a top piece. The top piece has an aperture for receiving a box opener to facilitate disassembling. The set also includes one or more planar assembly pieces and one or more non-planar assembly pieces. A planar assembly piece includes one or more keys, all of them flat and lying in the plane of the square body. A non-planar assembly piece includes at least one vertical key that is perpendicular to the plane of the square body. In the assembling method, a top piece is first selected to form part of the top side of the box. Then one or more planar assembly pieces are connected to the top piece to form the top side of the box. To form a side wall, a non-planar assembly piece is selected to connect to one of the planar assembly pieces in the top side. To finish the box, one or more planar pieces are added to form a larger flat surface and one or more non-planar pieces are added to form corners of a 90° angle.

During disassembling, two locked assembly pieces can be unlocked by pushing an indentation above the lock of one locked assembly piece that receives the key of the other locked assembly piece. Also, during disassembling, a box opener can be used to remove the top piece. The box opener comprises a handle and a lug, and the lug of the box opener can be inserted into the aperture of the top piece for engagement.

In some embodiments, an article of manufacture includes a plurality of assembly pieces. Each assembly piece comprises a square body and, on each side of the square body, either a key or a lock. A key is a tab attached to a side of the square body. A lock is a socket inside the square body. The plurality of assembly pieces forms a set and the set comprises assembly pieces of seven different shapes. A first shaped assembly piece comprises a flat key and three locks. A second shaped assembly piece comprises two flat keys on two adjacent sides of the square body and two locks on the other two sides of the square body. A third shaped assembly piece comprises a flat key and a vertical key that are on two adjacent sides of the square body and two locks that are on the other two sides of the square body. A fourth shaped assembly piece comprises two flat keys on two adjacent sides of the square body, and a vertical key and a lock on the other two sides of the square body. A fifth shaped assembly piece comprises two vertical keys on two adjacent sides of the square body, and a flat key and a lock on the other two sides of the square body. A sixth shaped assembly piece comprises a vertical key and a flat key on two opposing sides of the square body, and two locks on the other two sides of the square body. The set also includes a top piece that comprises a flat key on one side of the square body, and three locks on the other sides of the square body, and an aperture on the square body. The article of manufacture further includes a box opener. The box opener comprises a handle and a lug. The box opener is used to remove the top piece by engaging the lug into the aperture of the top piece. In one embodiment, each assembly piece further comprises one or more indentations on the surface of the square body. Each indentation is marked on the surface of the square body above a lock that is inside the square body. Indentations are used for pushing to unlock a key locked in a lock.

BRIEF DESCRIPTION OF THE DRAWINGS

These and other features of the present disclosure will become readily apparent upon further review of the following specification and drawings. In the drawings, like reference numerals designate corresponding parts throughout the views. Moreover, components in the drawings are not necessarily drawn to scale, the emphasis instead being placed upon clearly illustrating the principles of the present disclosure.

DETAILED DESCRIPTION

Embodiments of the disclosure are described more fully hereinafter with reference to the accompanying drawings, in which preferred embodiments of the disclosure are shown. The various embodiments of the disclosure may, however, be embodied in many different forms and should not be construed as limited to the embodiments set forth herein. Rather, these embodiments are provided so that this disclosure will be thorough and complete, and will fully convey the scope of the disclosure to those skilled in the art.

The present application discloses a new type of boxes that can be assembled and disassembled and reused as storage or shipping containers. A set of different assembly pieces are provided for construction of a box. The assembly pieces can be made of cardboard, plastic, metal, nylon, or any other suitable materials. Each assembly piece comprises a flat square referred to as a square body. The square body has four sides. On each side, there is either a key or a lock. In some embodiments, the key resembles a tab and is attached to a side of the square body. A lock is a socket inside the square body. In some embodiments, all assembly pieces have a same body and the keys are of the same uniform shape and size. The shape and the size of the locks closely resemble the shape and the size of the keys. A key of an assembly piece can therefore be inserted into a lock of another assembly piece and stay securely locked.

In some embodiments, the key or keys of an assembly piece are in the shape of a tab. The keys can be flat keys, lying in the same plane of the square body. The keys can be vertical keys, standing perpendicular to the plane of the square body. When an assembly piece comprises only flat keys, the assembly piece is referred to as "planar assembly piece." When an assembly piece has at least one vertical key, the assembly piece is referred to as "non-planar assembly piece."

Figure 1:
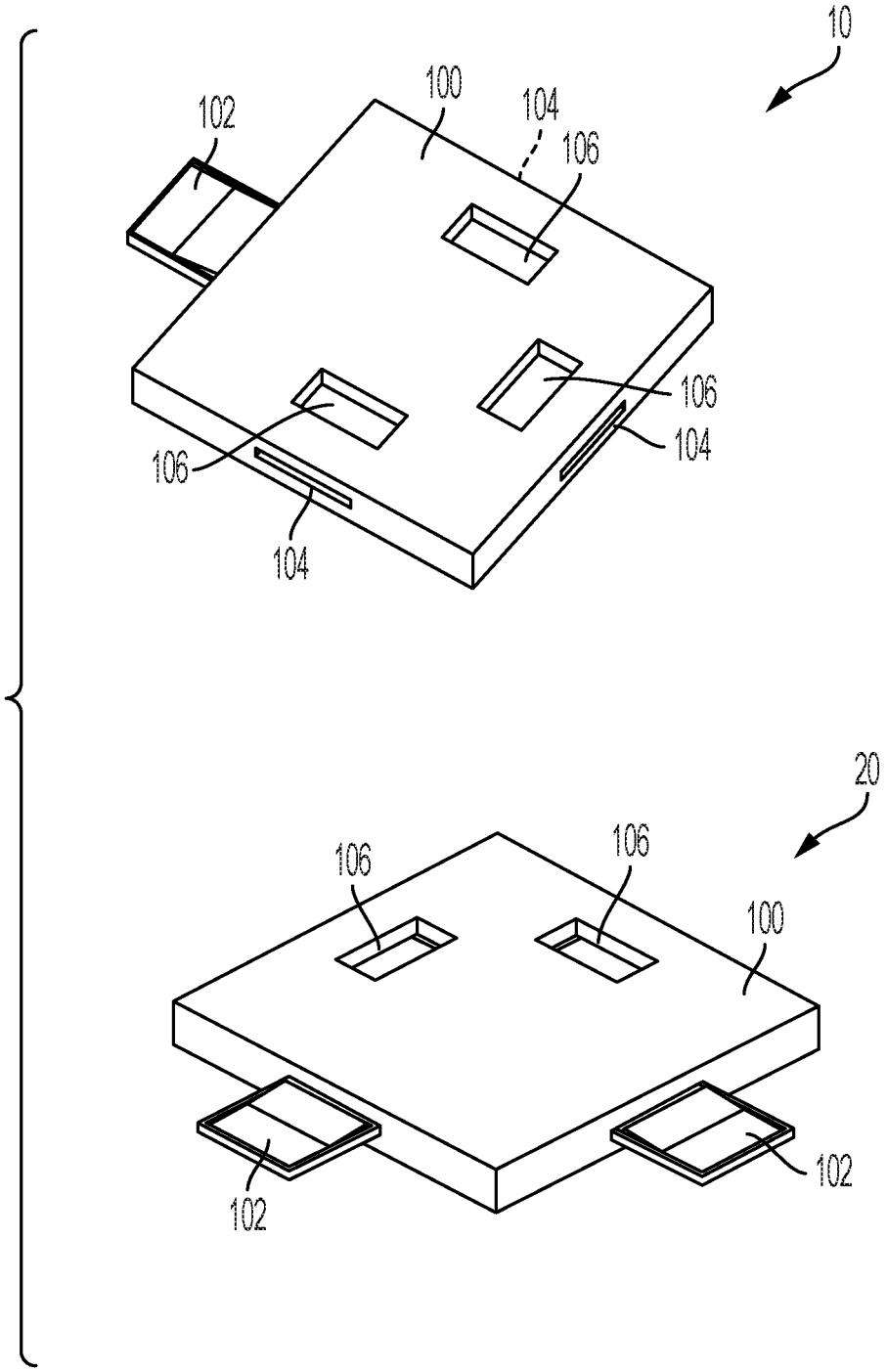
FIG. 1 is an illustration of different planar assembly pieces.

FIG. 1 illustrates two exemplary planar assembly pieces, 10 and 20. The planar assembly piece 10 comprises a square body 100, a flat key 102, three locks 104 (one hidden from the view), three indentations 106 (explained in the next paragraph). The square body 100 has four sides. On each side, there is either a key 102 or a lock 104. The planar assembly piece 10 has one key 102 and it is lying flat in the same plane as the square body 100. In some embodiments, a key 102 may comprise some surface structures to prevent it from inadvertently slipping out of the lock into which it is inserted. For example, a key 102 may have a smooth surface on one side and a structure in the shape of a prism on the other side, as shown in FIG. 1. To unlock the key 102, pressure has to be applied on the key 102 through the indentation 106 to push the key 102 out of the lock.

In FIG. 1, the planar assembly piece 10 has three indentations 106 marked on the surface of the square body 100. For reasons that will become clear later in the description, the surface of the square body 100 with marked indentations is referred to as the interior surface of the assembly piece. Each indentation 106 is situated above a lock 104. The indentation 106 can be used to unlock two locked assembly pieces during disassembling. For example, when two assembly pieces are locked, the key of one assembly piece is securely inserted into the lock of another assembly piece. To unlock these two locked pieces, pressure can be applied on the key in the lock through the indentation above the lock to push the key out of the lock.

The planar assembly piece 20 in FIG. 1 has two flat keys 102 and two locks (hidden from the view). Above the two locks, two indentations 106 are marked on the interior surface of the planar assembly piece 20.

Figure 2:
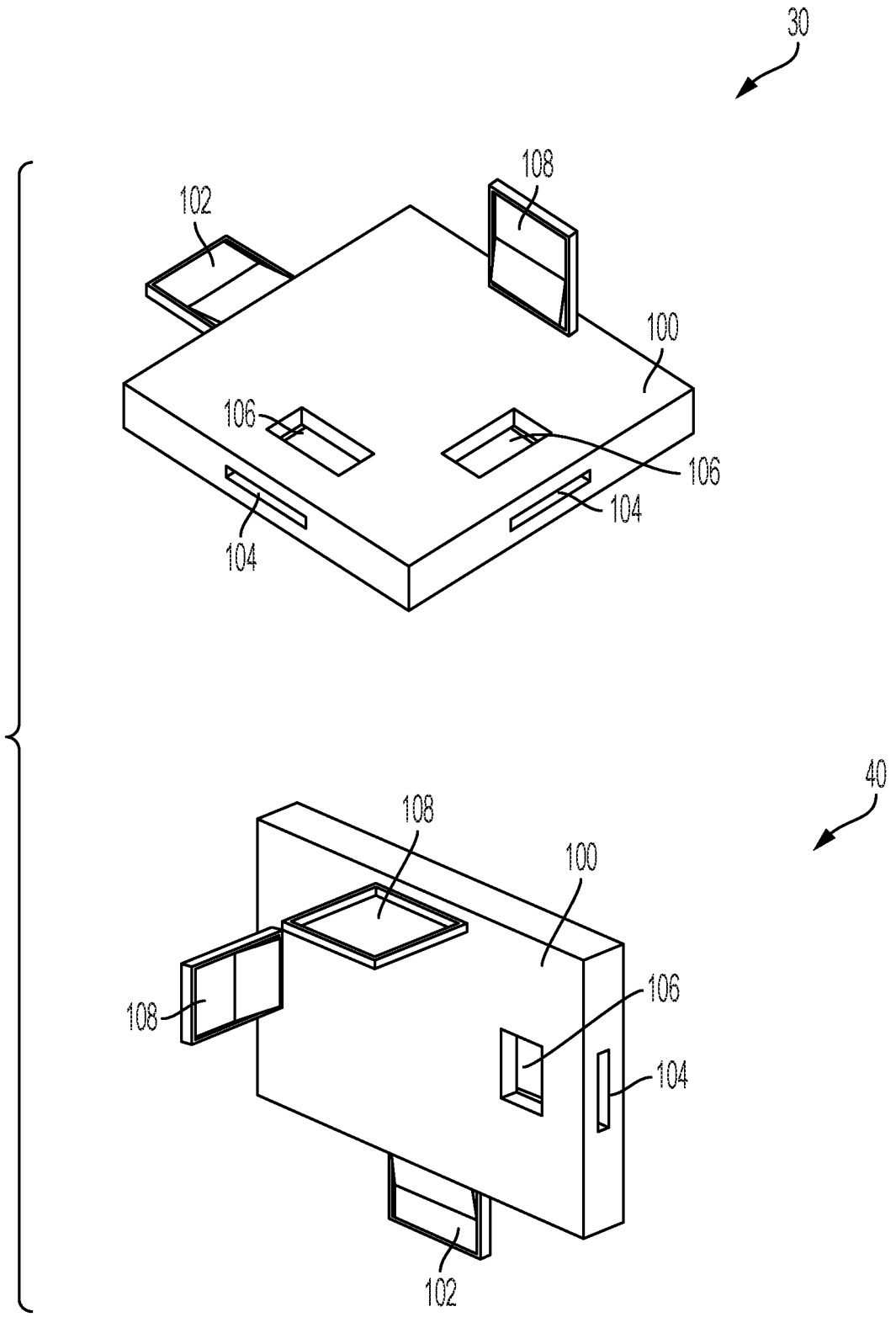
FIG. 2 is an illustration of different non-planar assembly pieces.

The two planar assembly pieces, 10 and 20, in FIG. 1 comprise one or more flat keys. FIG. 2 illustrate two assembly pieces, 30 and 40, that comprise at least one vertical key 108. Because the assembly pieces 30 and 40 are not flat as the assembly pieces 10 and 20, they are referred to as "non-planar" assembly pieces. In the non-planar assembly piece 30, a vertical key 108 stands on one side of and perpendicular to the square body 100. The square body 100 further comprises a flat key 102 and two locks 104 located on the other three sides of the square body 100. On the interior surface of the assembly piece 30 and above where the locks 104, indentations 106 are marked. As explained above, an indentation 106 is designed to allow pressure to be applied onto a key 106 to unlock the key that is inserted into the lock 104.

The non-planar assembly piece 40 in FIG. 2 comprises two vertical keys 108 located on two adjacent sides of the square body 100. The assembly piece 40 further comprises a flat key 102, a lock 104 and an indentation 106 marked on the interior surface of the assembly piece 40 above the lock 104.

The exemplary assembly pieces shown in FIG. 1 and FIG. 2 can be used for constructing a box. Two planar assembly pieces can be connected to form a larger flat surface. For example, the flat key 102 of the planar assembly piece 10 can be inserted to a lock 104 of another planar assembly piece, 10 or 20, to form a rectangle. A non-planar assembly piece can be connected to another assembly piece to form a corner of a 90° angle. For instance, the vertical key 108 of the non-planar assembly piece 30 can be inserted into one of the locks 104 of the planar assembly piece 10 to form a corner. For another example, the vertical key 108 of the non-planar assembly piece 30 can be inserted into the only lock 104 of the non-planar assembly piece 40 to form a corner. It is noted that in order to construct a complete box, a selection of assembly pieces of certain shapes and of certain numbers may be required. Embodiments and examples of how to construct a complete box will be explained in detail in the later part of this disclosure.

Figure 3A:
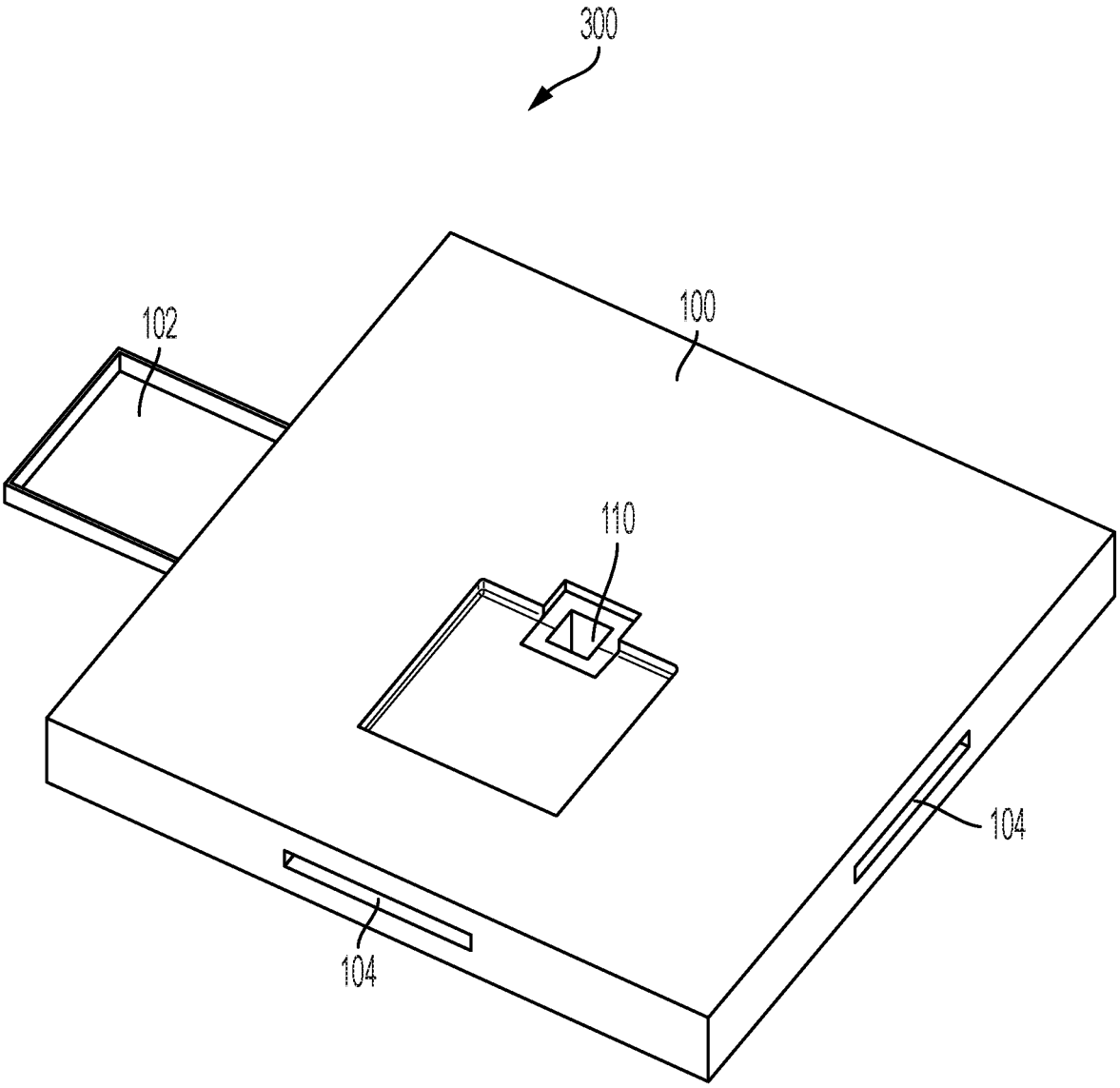
FIGS. 3*a*-3*b* are exemplary illustrations of a top assembly piece.
Figure 3B:
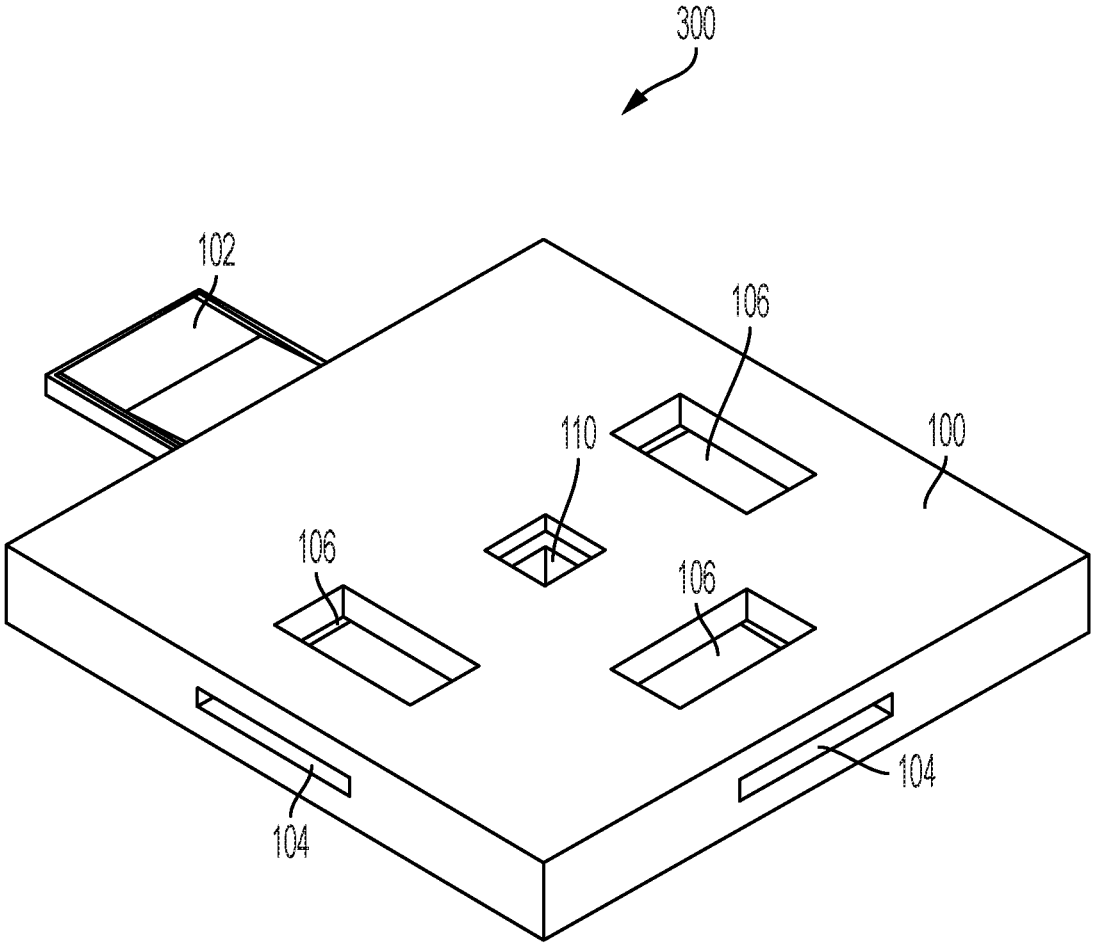

Among the assembly pieces selected to construct a complete box, it is preferable that a top piece is included in the selection. FIGS. 3*a*-3*b* illustrate an exemplary top piece 300. The top piece 300 comprises a square body 100, a flat key 102, and three locks 104 (one hidden from the view). FIG. 3*a* illustrates the exterior surface of the top piece 300. On the exterior surface, the top piece 300 comprises an aperture 110. In one embodiment, the aperture 110 may be located in the center of the square body 100. FIG. 3*b* illustrates the interior surface of the top piece 300. Three indentations 106 are marked on the interior surface above the locks 104. The aperture 110 is also visible from the interior side of the top piece 300.

Figure 4:
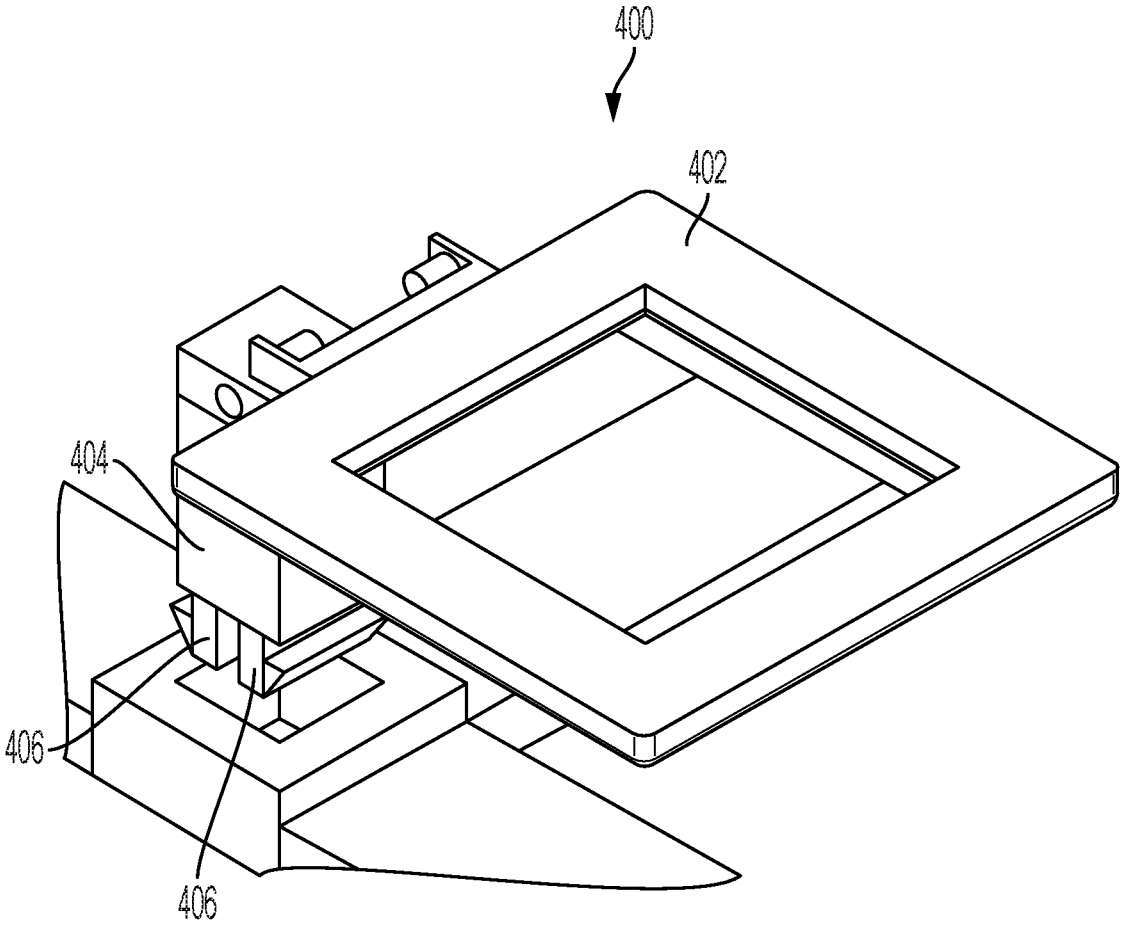
FIG. 4 is an illustration of an exemplary box opener.

In a completed box, all sides are finished and the box is enclosed. To disassemble the box, a box opener may be provided to open the enclosed box. FIG. 4 illustrates an exemplary box opener 400. The box opener 400 comprises a handle 402 and a lug 404. The handle 402 can be of any shape that is easy to grip, e.g., a ring, a loop, etc. In FIG. 4, the lug 404 is a cuboid with two chamfered heads 406. The heads 406 are spaced apart and have a dimension slightly larger than the size of the aperture. This allows the two heads 406 to be pushed closer when passing through the aperture 110 as the lug 404 is inserted into the aperture 110. Once the heads 406 pass through the aperture 110, they regain their normal position to allow the lug 404 to firmly engage the aperture 110. When the box opener 400 is engaged in the aperture 110, the top piece 300 can be lifted to open the enclosed box.

Generally, a finished box may include a top piece 300 for ease of opening during disassembling. The top piece 300 may be on the top side of the box when the box is not empty, or on any other side. To construct a complete box, a variety of assembly pieces are needed. FIGS. 5*a*-5*f* illustrate an exemplary set of assembly pieces. The set includes assembly pieces of six different shapes or configurations. In some embodiments, the six configurations are what is required to construct a box of different sizes and shapes. The number of assembly pieces of each configuration may vary in a finished box, depending on the size or shape of the box. In some embodiments, the set further includes one or more top pieces 300.

Figure 5A:
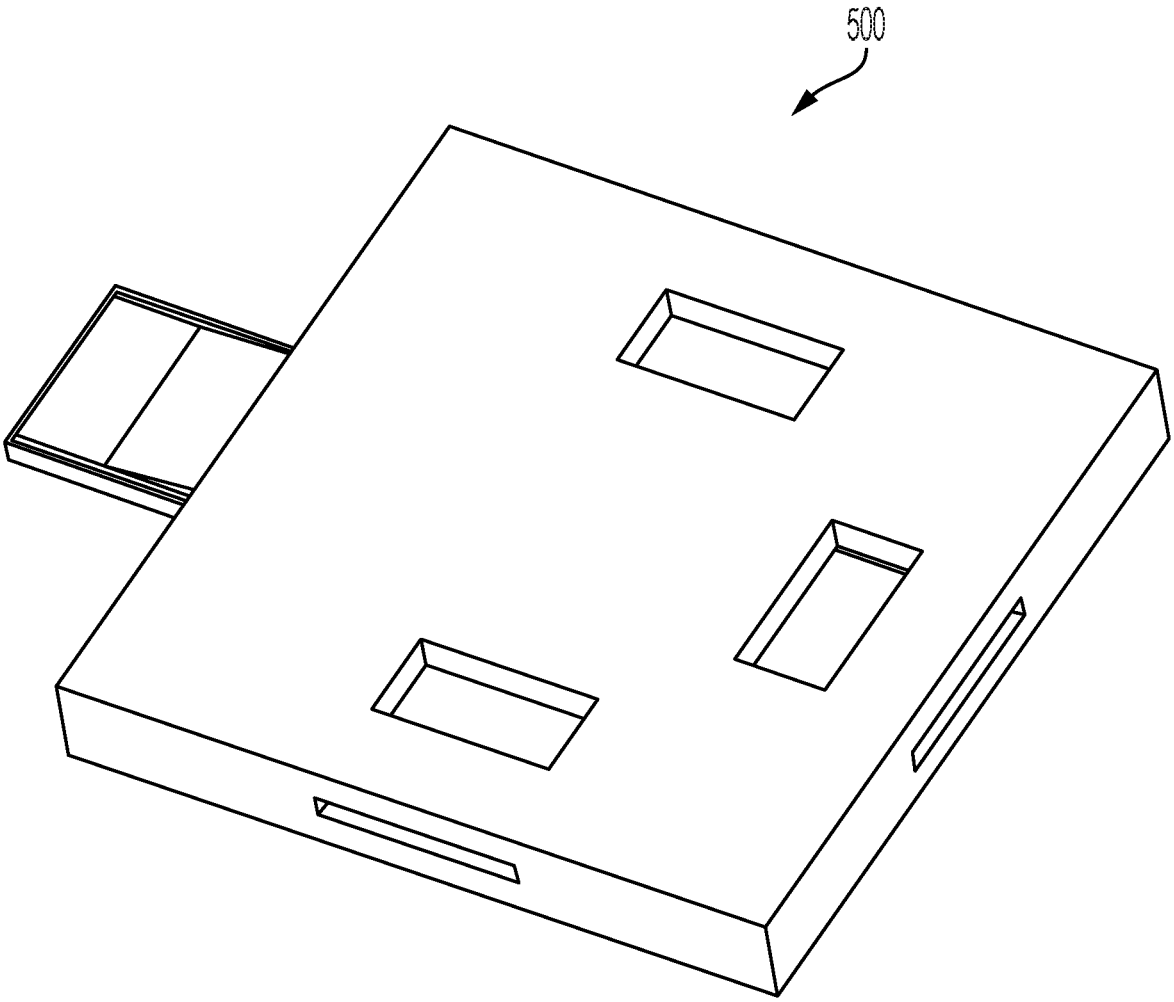
FIGS. 5*a*-5*f* illustrate the differently shaped assembly pieces in one exemplary embodiment.
Figure 5B:
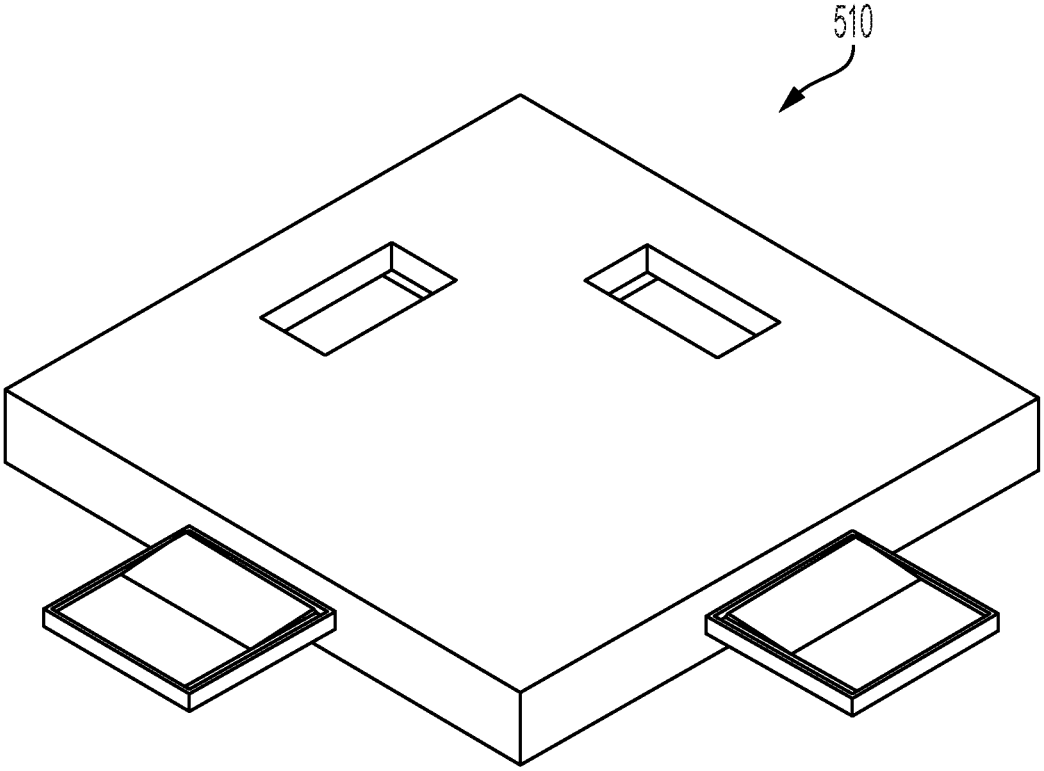
Figure 5C:
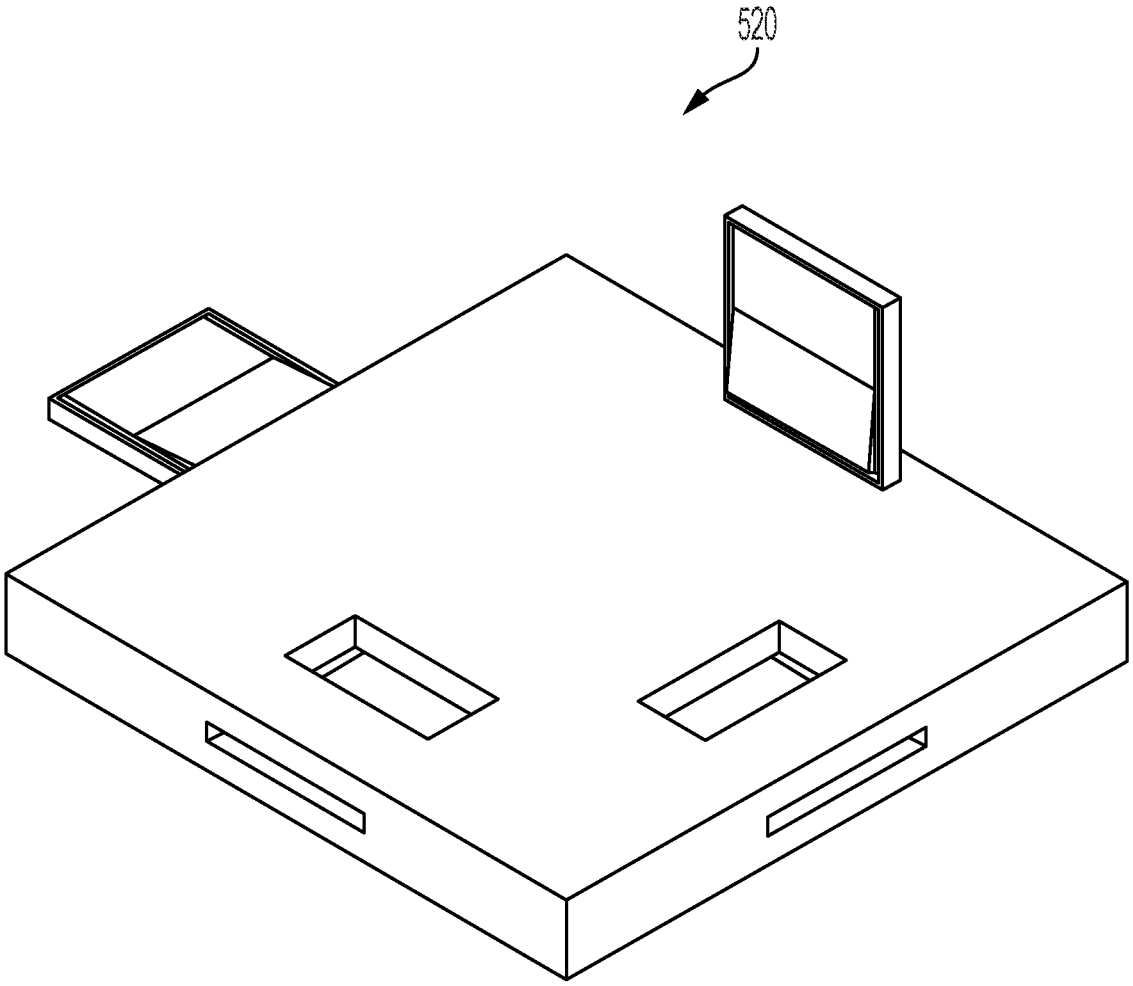
Figure 5D:
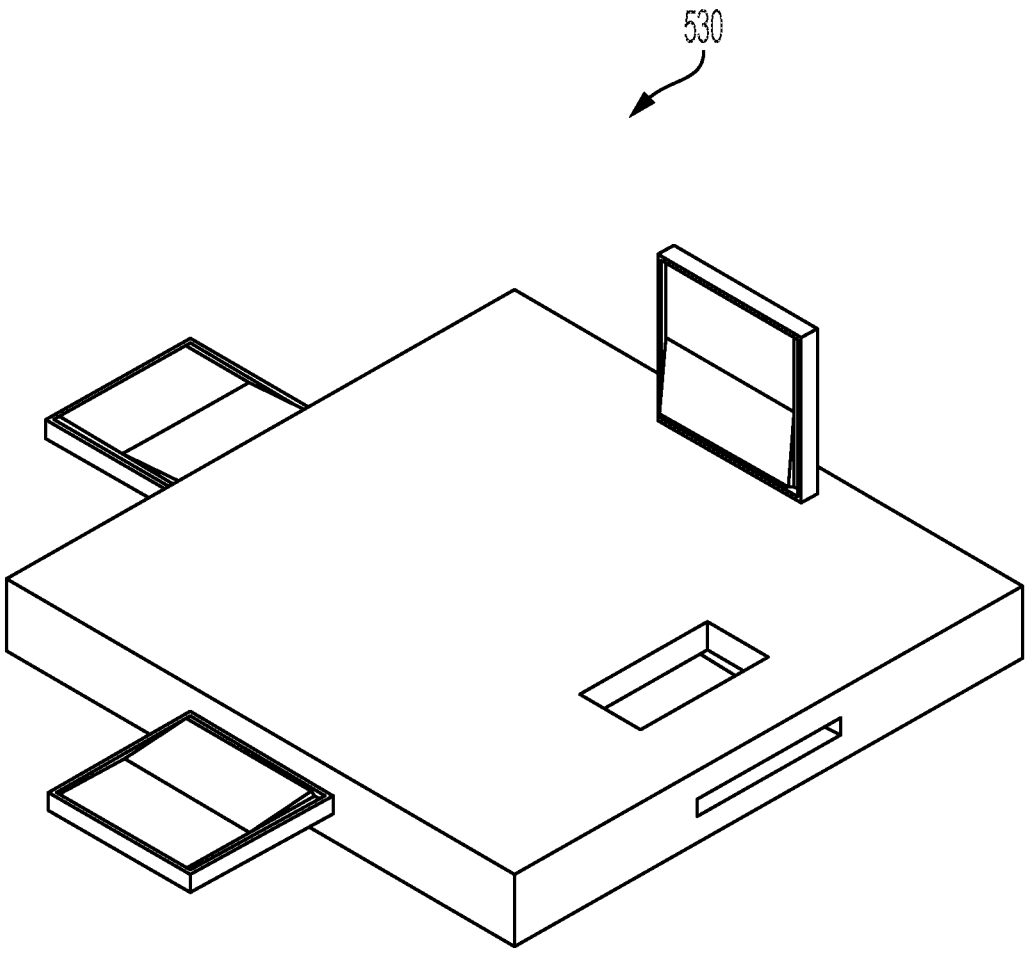
Figure 5E:
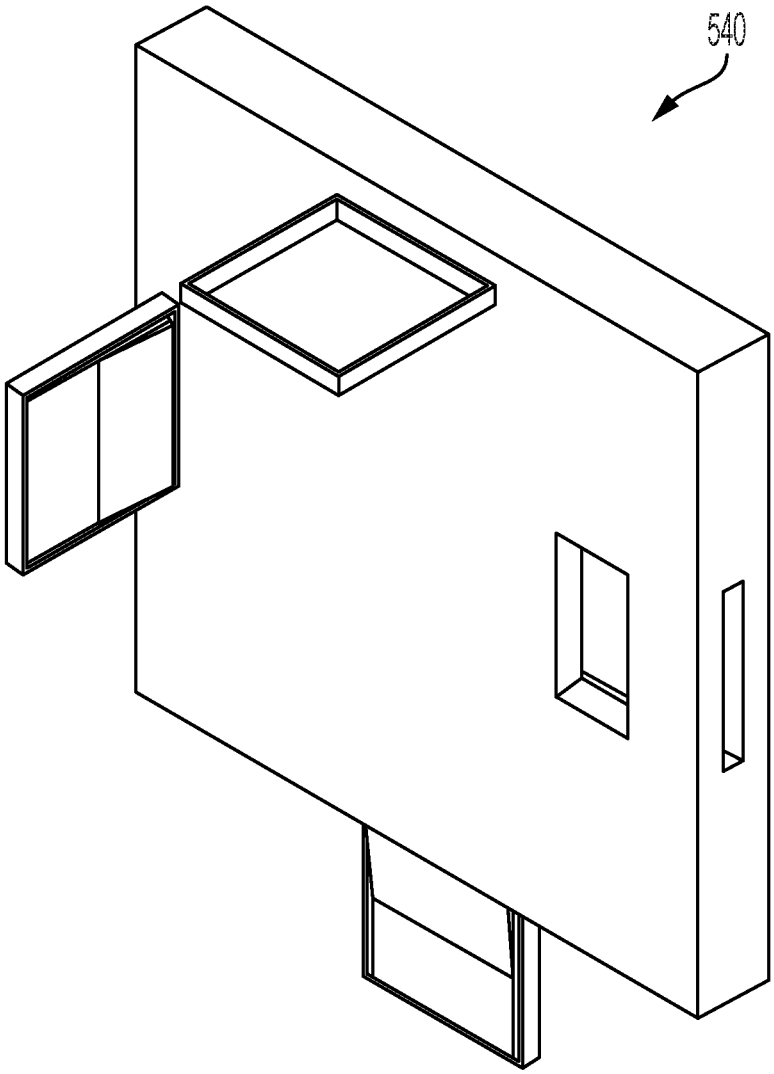
Figure 5F:
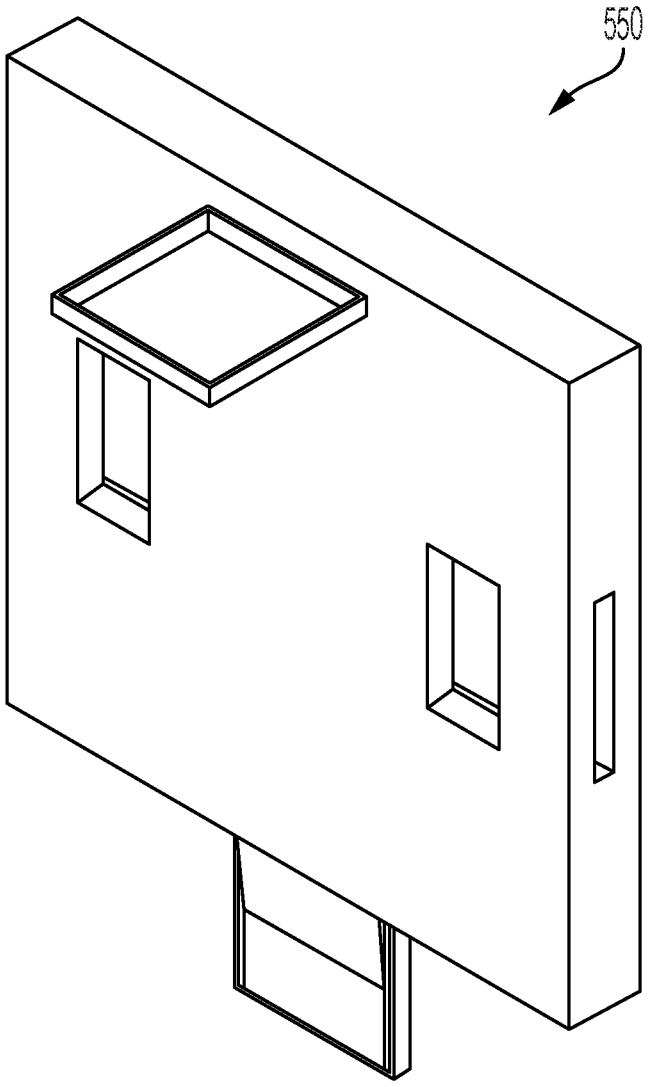

In FIG. 5*a*, a first shaped assembly piece 500 is depicted. The first shaped assembly piece 500 comprises a square body, a flat key and three locks. Indentations are also marked on the interior surface of the assembly piece above the locks. A second shaped assembly piece 510 is illustrated in FIG. 5*b*. The second shaped assembly piece 510 comprises two flat keys attached to two adjacent sides of the square body and two locks on the other two sides. Both the first shaped assembly piece 500 and the second shaped assembly piece 510 are planar pieces.

Figure 6:
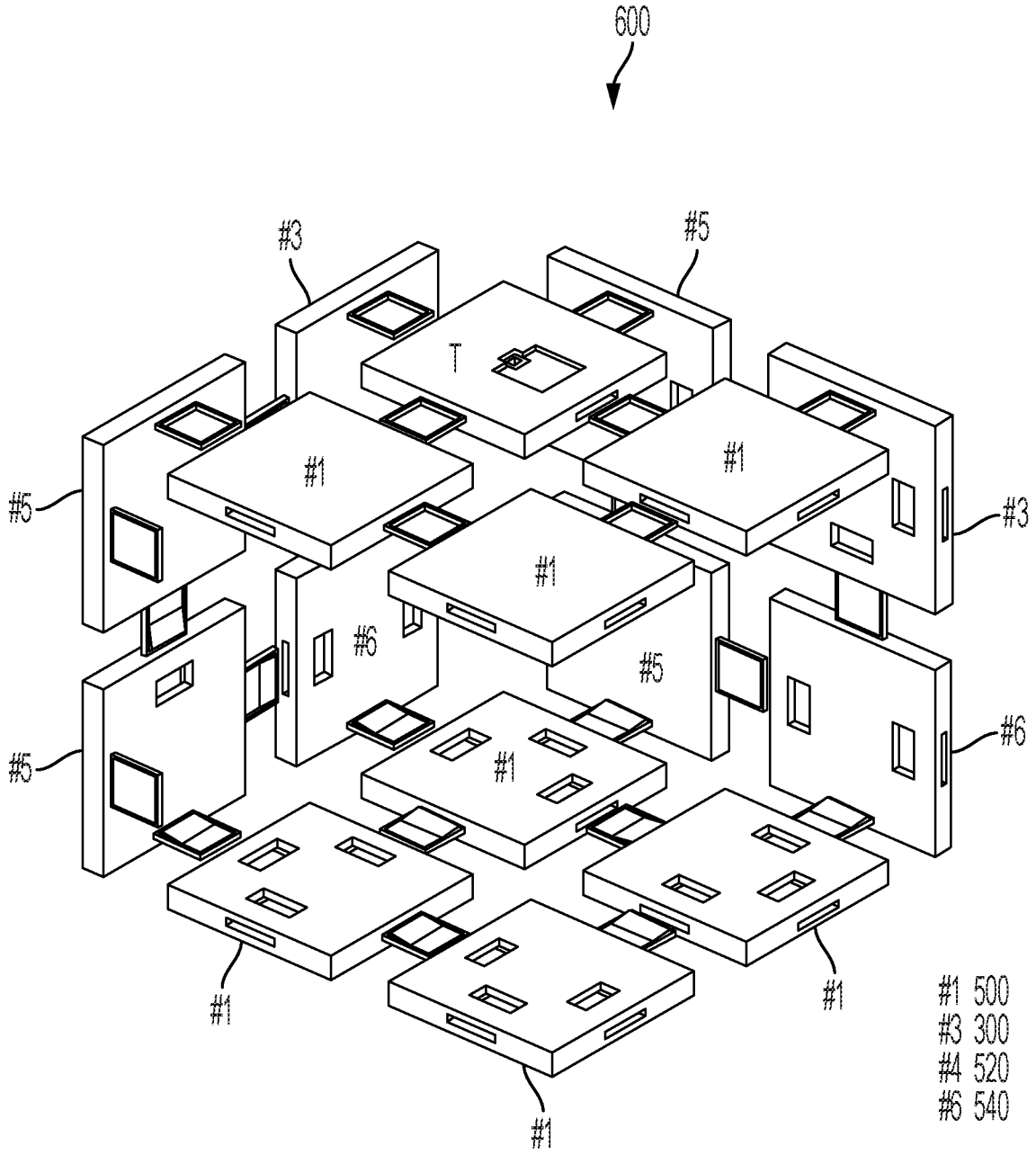
FIG. 6 illustrates an exemplary method of constructing a small box.
Figure 7:
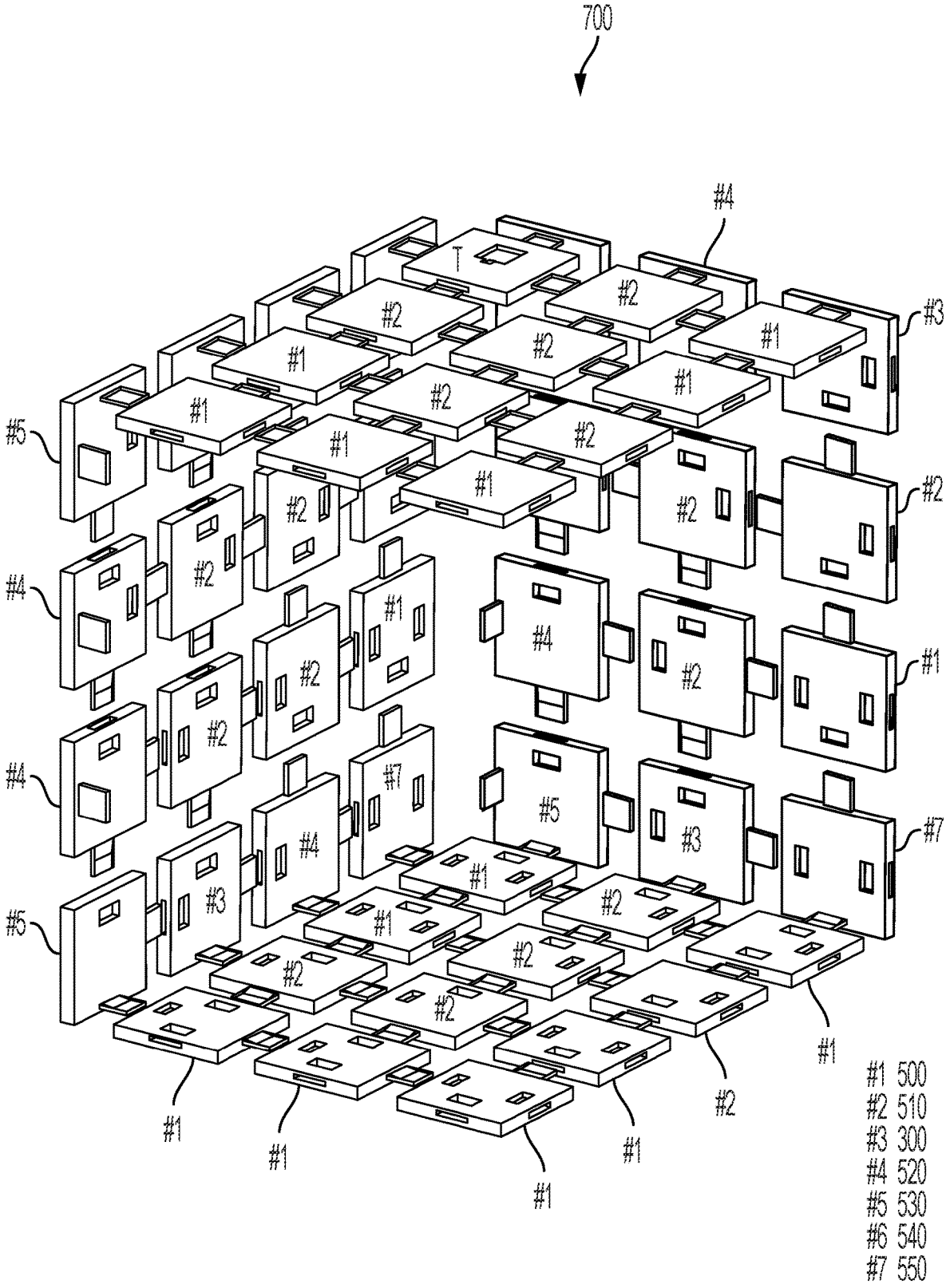
FIG. 7 illustrates an exemplary method of constructing a large box.

In FIGS. 5*c*-5*f*, four non-planar assembly pieces are shown. A third shaped assembly piece 520 in FIG. 5*c* comprises a flat key and a vertical key attached to two adjacent sides of the square body and two locks on the other two sides. A fourth shaped assembly piece 530 shown in FIG. 5*d* comprises two flat keys attached to two adjacent sides of the square body, a vertical key and a lock on the other two sides. A fifth shaped assembly piece 540 shown in FIG. 5*e* comprises two vertical keys attached to two adjacent sides of the square body and one flat key and a lock on the other two sides. A sixth shaped assembly piece 550 shown in FIG. 5*f* comprises one vertical key and one flat key attached to two opposing sides of the square body and two locks on the other two sides. In some embodiments, the six different configurations of the assembly pieces are necessary and sufficient in completing the construction of a box. That is, all six configurations are needed and no other configuration is required in order to complete a box. FIG. 6 and FIG. 7 illustrate how to complete two boxes of different sizes using a set of assembly pieces that includes one or more assembly pieces of each configuration shown in FIGS. 5*a*-5*f*.

FIG. 6 illustrates how to construct a small box 600 using the assembly pieces selected from the set. The number marked on each assembly piece indicates the numbered configuration, e.g., first shaped, second shaped, . . . , sixth shaped, etc. The top piece near to the top corner on the far side is marked as T. In FIG. 6, the box is a cube (2×2×2 pieces) and is constructed with 24 assembly pieces, 4 for each side of the cube. To facilitate viewing, only four sides of the box are shown. The bottom of the box comprises four first shaped assembly pieces. They connect to form a flat surface. The top of the box also comprises four assembly pieces, three first shaped and one top piece. The sidewall on the righthand side comprises four connected assembly pieces: a third shaped assembly piece, a sixth shaped assembly piece, and two fifth shaped assembly pieces. By way of symmetry, the sidewall on the left-hand side comprises the same assembly pieces. So do the two sidewalls that are not shown in FIG. 6.

In constructing the box shown in FIG. 6, assembly pieces of five configurations—first, third, fourth, sixth plus the top piece—are utilized. In some embodiments, assembly pieces of all seven configurations—first, second, third, fourth, fifth, sixth, and top—are needed, as shown in the large box 700 illustrated in FIG. 7.

The large box 700 is a cuboid (4×3×4 pieces) and is constructed with 90 assembly pieces. The top side and the bottom side of the box 700 each include 12 assembly pieces, all of which are planar assembly pieces such as the first shaped and the second shaped assembly pieces. The top side of the box 700 also includes a top piece marked as T. The sidewall on the backside of the box 700 comprises 12 assembly pieces, each of the shape as marked in the drawing. By way of symmetry, the sidewall on the frontside of the box 700 (not shown) comprises the same pieces. The sidewall on the left-hand side of the box 700 comprises 16 assembly pieces that include both planar and non-planar pieces. The shapes are also marked as shown in FIG. 7. The sidewall on the right-hand side of the box 700 (not shown) comprises the same pieces as the sidewall on the left-hand side.

In the large box 700, assembly pieces of all seven configurations are utilized during construction. In some embodiments, the configurations illustrated in FIGS. 5*a*-5*f* plus the top piece illustrated in FIG. 6 are all that is needed in constructing a box. A manufacturer may choose to manufacture assembly pieces of these seven configurations only.

The number of each configuration can be statistically decided based on the size and shape of the boxes in anticipated demand.

Finally, it is noted that the interior surface of each assembly piece in an assembled box generally faces towards the interior of the box. In some embodiments, the exterior surface of an assembly piece may comprise structures such as handles, pockets, etc. The exterior surfaces may be decorated as well, or printed with trademarks, logos, taglines, etc.

Although the disclosure is illustrated and described herein with reference to specific embodiments, the disclosure is not intended to be limited to the details shown. Rather, various modifications may be made in the details within the scope and range of equivalents of the claims and without departing from the disclosure.

What is claimed is:

1. An apparatus for assembling a packing box, comprising:

a set of assembly pieces, wherein each assembly piece comprises a square body, said square body including four sides that form a plane of the square body, wherein in each assembly piece, either a key or a lock is disposed on each of the four sides of the square body, wherein each key is a tab fixed to a side of the square body and each lock is a slit inside the square body and wherein one assembly piece connects with another assembly piece through insertion of a key of either piece into a lock of the other piece; and a box opener comprising a handle and a lug, the lug defining a first width, wherein the set of assembly pieces comprises a top piece configured with an aperture to receive the lug of the box opener for removal of the top piece during disassembling, wherein the aperture defines a second width being smaller than the first width, and the lug is configured to be compressed when passing through the aperture and to decompress after passing through a depth of the aperture, thereby engaging the lug to the top piece.

2. The apparatus of claim 1, wherein each key of each assembly piece is of the same shape and wherein each lock of each assembly piece is of the same shape as any key.

3. The apparatus of claim 2, wherein the set of assembly pieces includes at least one planar assembly piece, all keys of which are flat key that lie in the plane of the square body of the at least one planar assembly piece.

4. The apparatus of claim 3, wherein the set of assembly pieces includes at least one non-planar assembly piece that comprises at least on vertical key that is perpendicular to the plane of the square body of the at least one non-planar assembly piece.

5. The apparatus of claim 3, wherein, when one or more of the planar assembly pieces are connected, they form a flat surface.

6. The apparatus of claim 4, wherein, when the at least one vertical key of the at least one non-planar assembly piece is inserted into another assembly piece, he two assembly pieces form a 90° angle.

7. The apparatus of claim 1, wherein a plurality of assembly pieces selected from the set is connected to form a box.

8. The apparatus of claim 7, wherein the plurality of assembly pieces selected to construct a box includes the top piece.

9. The apparatus of claim 1, wherein the square body of each assembly piece comprises an indentation marked on a surface of the square body above each lock, said indentation being used for pushing to unlock two locked assembly pieces.

10. An apparatus for building a packing box, said apparatus including a plurality of assembly pieces, each assembly piece comprising a square body having four sides forming a plane of the square body, wherein in each assembly piece, either a key or a lock, is disposed on each of the four sides of the square body, wherein each key is a tab fixed to a side of the square body and each lock is a slit inside the square body, wherein each key is either a flat key, which is a planar key inside the plane of the square body, or a vertical key, which is a key that is perpendicular to the plane of the square body, the plurality of assembly pieces comprising:

one or more first shaped assembly pieces, wherein each first shaped assembly piece comprises a square body of the first shaped assembly piece, a flat key of the first shaped assembly piece and three locks of the first shaped assembly piece, wherein the flat key of the first shaped assembly piece and the three locks of the first shaped assembly piece are separately disposed on each side of the square body of the first shaped assembly piece;

one or more second shaped assembly pieces, wherein each second shaped assembly piece comprises a square body of the second shaped assembly piece, two flat keys of the second shaped assembly piece disposed on two adjacent sides of the square body of the second shaped assembly piece and two locks on the other two sides of the square body of the second shaped assembly piece;

one or more third shaped assembly pieces, wherein each third shaped assembly piece comprises a square body of the third shaped assembly piece, a flat key of the third shaped assembly piece and a vertical key of the third shaped assembly piece that are disposed on two adjacent sides of the square body of the third shaped assembly piece, and two locks of the third shaped assembly piece that are on other two sides of the square body of the third shaped assembly piece;

one or more fourth shaped assembly pieces, wherein each fourth shaped assembly piece comprises a square body of the fourth shaped assembly piece, two flat keys of the fourth shaped assembly piece disposed on two adjacent sides of the square body of the fourth shaped assembly piece, and a vertical key of the fourth shaped assembly piece and a lock of the fourth shaped assembly piece that are disposed on other two sides of the square body of the fourth shaped assembly piece;

one or more fifth shaped assembly pieces, wherein each fifth shaped assembly piece comprises a square body of the fifth shaped assembly piece, two vertical keys of the fifth shaped assembly piece disposed on two adjacent sides of the square body of the fifth shaped assembly piece, and a flat key of the fifth shaped assembly piece and a lock of the fifth shaped assembly piece that are disposed on other two sides of the square body of the fifth shaped assembly piece;

one or more sixth shaped assembly pieces, wherein each sixth shaped assembly piece comprises a square body of the sixth shaped assembly piece, a vertical key of the sixth shaped assembly piece and a flat key of the sixth shaped assembly piece that are disposed on two opposing sides of the square body of the sixth shaped assembly piece, and two locks of the sixth shaped assembly piece that are disposed on other two sides of the square body;

a top piece that comprises a square body of the top piece, a flat key of the top piece that is disposed on one side of the square body of the top piece and three locks of the top piece that are disposed on other three sides of the square body of the top piece, and an aperture on the square body of the top piece; and a box opener comprising a handle and a lug defining a first width, the box opener being configured to remove the top piece by engaging the lug in the aperture of the top piece, the aperture defining a second width that is smaller than the first width, and the lug being compressed when passing through the aperture and decompress after passing through a depth of the aperture, thereby engaging the lug to the top piece.

11. The apparatus of claim 10, wherein each assembly piece further comprises one or more indentations on a surface of the square body and wherein each indentation sits above each lock and allows for access to a key which can be pushed on to unlock the key locked in the lock.

* * * * *